US009670931B2

(12) United States Patent
Emelli

(10) Patent No.: US 9,670,931 B2
(45) Date of Patent: Jun. 6, 2017

(54) ROTARY VACUUM PUMP

(71) Applicant: AGILENT TECHNOLOGIES, INC., Loveland, CO (US)

(72) Inventor: Enrico Emelli, Villar Dora (IT)

(73) Assignee: Agilent Technologies Inc., Santa Clara, CA (US)

( * ) Notice: Subject to any disclaimer, the term of this patent is extended or adjusted under 35 U.S.C. 154(b) by 768 days.

(21) Appl. No.: 14/135,541

(22) Filed: Dec. 19, 2013

(65) Prior Publication Data

US 2014/0205432 A1 Jul. 24, 2014

(30) Foreign Application Priority Data

Jan. 22, 2013 (EP) ..... 13152249

(51) Int. Cl.
*F04D 19/04* (2006.01)
*F04D 29/32* (2006.01)

(52) U.S. Cl.
CPC ..... *F04D 19/042* (2013.01); *F04D 19/046* (2013.01); *F04D 29/324* (2013.01)

(58) Field of Classification Search
CPC ..... F04D 19/042; F04D 19/046; F04D 29/324
See application file for complete search history.

(56) References Cited

U.S. PATENT DOCUMENTS 3,826,588 A * 7/1974 Frank ..... F04D 19/042 415/199.5
6,412,173 B1 * 7/2002 Johnson ..... B23C 3/32 29/889.23
6,435,811 B1 8/2002 Beyer et al.
6,474,940 B1 * 11/2002 Yamauchi ..... F04D 19/042 415/199.5
2001/0055526 A1 * 12/2001 Kawasaki ..... F04D 17/168 415/90
2005/0025640 A1 * 2/2005 Sekiguchi ..... F04D 17/168 417/423.4
2005/0042118 A1 2/2005 Sekiguchi et al.
2008/0260518 A1 * 10/2008 Blumenthal ..... F04D 19/044 415/90

(Continued)

FOREIGN PATENT DOCUMENTS

CN 1292851 A 4/2001
CN 1529794 A 9/2004
DE 29715035 12/1997

(Continued)

OTHER PUBLICATIONS

Extended European Search Report mailed Jul. 22, 2013 in European Patent Application No. 13152249.2.

*Primary Examiner* — Woody Lee, Jr.

(57) ABSTRACT

A rotary vacuum pump includes a first set of pumping stages having rotor discs with a first diameter and a second set of pumping stages having rotor discs with a second different diameter and further comprising an intermediate pumping stage that is particularly adapted for matching the change in the diameter of the pump rotor discs. According to the invention, the intermediate pumping stage comprises a rotor disc having an outer portion in the radial direction that is axially tapered from its inner diameter to its outer diameter and a corresponding stator stage including a spacer ring that is axially tapered from its periphery toward its center.

18 Claims, 5 Drawing Sheets

(56) References Cited

U.S. PATENT DOCUMENTS

| | | | | |
|---|---|---|---|---|
| 2009/0246038 | A1* | 10/2009 | Kawasaki | F04D 17/168<br>417/203 |
| 2010/0047096 | A1* | 2/2010 | Sekiguchi | F04D 19/04<br>417/423.4 |

FOREIGN PATENT DOCUMENTS

| | | | |
|---|---|---|---|
| EP | 0965761 | | 12/1999 |
| EP | 1167773 | | 1/2002 |
| EP | 1496263 | | 1/2005 |
| EP | 1508700 | | 2/2005 |
| WO | 02/055883 | A2 | 7/2002 |

* cited by examiner

ROTARY VACUUM PUMP

CROSS-REFERENCE TO RELATED APPLICATIONS

The present application claims priority under 35 U.S.C. §119(e) from European Application No. 131522492 filed on Jan. 22, 2013 naming Enrico Emelli as inventor. The entire disclosure of European Patent Application No. 13152249.2 is specifically incorporated herein by reference.

BACKGROUND

A rotary vacuum pump is a vacuum pump comprising a pump housing having an inlet port and an outlet port and a plurality of pumping stages arranged between the inlet port and the outlet port and suitable for pumping a gas from the inlet port to the outlet port.

Each pumping stage substantially consists of a stator ring which is integral with the pump housing and of a rotor disc which is integral with a rotating shaft that is centrally arranged in the pump housing and that is driven in rotation at high speed by a motor.

Depending on the kind of pump, higher or lower vacuum degrees can be obtained.

Turbomolecular pumps are suitable for generating a vacuum degree of the order of $10^{-7}$ mbar (i.e. $10^{-5}$ Pa).

With reference to FIG. 1, a turbomolecular pump 100 comprises a pump housing 102 in which an inlet port 104 and an outlet port 106 are defined, a plurality of pumping stages being arranged inside the housing 102 between the inlet port 104 and the outlet port 106. More particularly the turbomolecular pump 100 typically comprises a first region A at lower pressure, arranged closer to the inlet port 104 and comprising a plurality of turbomolecular pumping stages 108*a*, and a second region B at higher pressure, arranged downstream the first region A in the flow direction of the pumped gas and closer to the outlet port 106 and comprising a plurality of molecular drag pumping stages 108*b*.

Both turbomolecular pumping stages 108*a* and molecular drag pumping stages 108*b* comprise respective stator rings 112*a*, 112*b* integral with the pump housing 102 and rotor discs 114*a*, 114*b* integral with a central rotating shaft 110, the stator rings and rotor discs cooperating with each other for obtaining a pumping effect.

FIG. 2 shows in detail a turbomolecular pumping stage 108*a*. As mentioned above, such pumping stage comprises a stationary stator ring 112*a* cooperating with a rotor disc 114*a* driven in rotation by the rotating shaft 110.

The function of the rotor disc 114*a* is mainly to pump the gas molecules, while the function of the stator ring 112*a* is mainly to successively change the speed distribution of the gas molecules, before they are intercepted and pumped by the rotor disc 114*a*' of the following pumping stage.

Both the stator ring 112*a* and the rotor disc 114*a* are equipped with respective radial blades 116*a*, 118*a*, which are equally spaced in the circumferential direction and oriented with opposite leads with respect to the rotation plan in order to perform pumping of gas molecules.

The number of the rotor and stator blades and the geometry thereof strongly affect the performances of the pumping stage. More particularly, the axial clearance between cooperating stator rings and rotor discs has to be kept narrow in order to obtain satisfactory performances, namely in terms of attainable vacuum degree.

The rotor discs 114*a* together with their blades 118*a* are typically obtained by milling.

The stator rings 112*a* together with their blades 116*a* could also be obtained by milling. However, this technology is very expensive, so that stator rings are preferably obtained by stamping: the use of this technology imposes many limitations and constraints on the geometry of the stator rings, but it allows for a remarkable reduction of the manufacturing costs.

In many turbomolecular pumps the rotor discs of the turbomolecular pumping stages all have the same diameter.

However, there are specific applications where it is desirable to have rotor discs with different diameters.

FIG. 3 partially shows in a very schematic way a turbomolecular pump 200 of the prior art suitable for such applications. The region at lower pressure of this turbomolecular pump 200 comprises a first set I of turbomolecular pumping stages 208*a*' with rotor discs 214*a*' having a smaller diameter followed (in the flow direction of the pumped gas) by a second set II of turbomolecular pumping stages 208*a*" with rotor discs 214*a*" having a larger diameter.

As mentioned above, the rotor discs 214*a*', 214*a*" are carried by a common rotating shaft 210 and they are equipped with rotor blades 218*a*', 218*a*".

Each turbomolecular pumping stage also includes a corresponding stator stage 212*a*', 212*a*" comprising a substantially cylindrical spacer ring 220*a*', 220*a*" which is integral with the pump housing 202 and which supports a corresponding bladed stator ring 216*a*', 216*a*".

It is evident that in the arrangement shown in FIG. 3 the pump housing 202 and the stator stages 212*a*', 212*a*" integral therewith are configured so as to accommodate the diameter change of the rotor discs. More particularly, the stator stage of the pumping stage at the rotor diameter transition region comprises a spacer ring 220*a** having an L-shaped cross-section in order to follow the outline of the pump housing wall.

However, such known solution is affected by a severe drawback since a wide axial clearance 222 is formed at the rotor diameter transition region, i.e. at the L-shaped spacer ring 220*a*.

Such axial clearance involves a remarkable degradation of the pumping stage performances.

The axial size of the clearance 222 could be reduced by reducing the thickness of the spacer ring 220*a*; however, the spacer ring 220*a* has to be thick enough to ensure the mechanical stability thereof, which prevents any possibility to reduce the axial size of the axial clearance 222 beyond a certain limit.

In order to overcome the above drawback, it would be possible to provide at the rotor diameter transition region a stator stage having a specially designed geometry and comprising a spacer ring and a bladed stator ring made as single piece for reducing to a minimum the axial clearance.

However, for carrying out this kind of solution it would be necessary to manufacture the stator stage at the rotor diameter transition region by milling, which would increase the manufacturing costs.

Therefore, the main object of the present invention is to provide a rotary vacuum pump comprising a first set of pumping stages having rotor discs with a first diameter and a second set of pumping stages having rotor discs with a second different diameter wherein the axial clearance between the rotor discs and the cooperating stator stages of the pumping stages can be kept very narrow even at the rotor diameter transition region so as to optimize the pump performances, without entailing any increase in manufacturing costs. More particularly, the main object of the present invention is to overcome the drawbacks of prior art by providing a rotary vacuum pump comprising a pumping stage that is specifically designed for matching a change in the pump rotor diameter.

In other words, the main object of the present invention is to provide a rotary vacuum pump comprising a first set of pumping stages having rotor discs with a first diameter and a second set of pumping stages having rotor discs with a second different diameter and further comprising a pumping stage suitable for being arranged between the first set of pumping stages and the second set of pumping stages and designed so that the axial clearance between its rotor disc and its cooperating stator stage—as well as the axial clearance with the adjacent pumping stages—can be kept very narrow.

This and other objects are achieved by a rotary vacuum pump as claimed in the appended.

SUMMARY

The rotary vacuum pump according to the invention comprises a first set of pumping stages having rotor discs with a first diameter and a second set of pumping stages having rotor discs with a second different diameter and further comprises an intermediate pumping stage suitable for being arranged between the first set of pumping stages and the second set of pumping stages and comprising a rotor disc having an outer portion in the radial direction that is axially tapered from its inner diameter to its outer diameter and a corresponding stator stage comprising a spacer ring that is axially tapered from its periphery toward its center.

It is evident that the diameter of the rotor disc of such intermediate pumping stage will be comprised between the first diameter and the second diameter.

Thanks to the matching tapered geometry of the rotor disc and of the spacer ring of the corresponding stator stage, the axial clearance of the intermediate pumping stage can be kept very narrow, thus avoiding any deterioration of the pump performances.

According to a preferred embodiment of the present invention, the rotary vacuum pump is a turbomolecular pump, whereby the rotor discs of the pumping stages are provided with a plurality of radial blades; correspondingly, in the intermediate pumping stage, an outer portion in the radial direction of the blades of the rotor disc are axially tapered, and the stator stage comprises a bladed stator ring and an axially tapered spacer ring.

According to a preferred embodiment of the present invention, the tapering of the rotor disc and/or of the spacer ring of the stator stage is smooth and continuous.

As an alternative, the tapering of the rotor disc and/or of the spacer ring of the stator stage could be obtained through a stepped configuration.

As a further alternative, the tapering of the rotor disc and/or of the spacer ring of the stator stage can also be obtained through a combination of the above solutions; for instance, in the illustrated example the spacer ring 7 of the stator stage 3 comprises a first portion 7' with a stepped configuration and a second portion 7" smoothly and continuously tapered. Advantageously, thanks to the claimed solution stator rings obtained by stamping can be used in all the pump, including the stator ring of the intermediate pumping stage provided at the rotor diameter transition region, whereby the need for any expensive manufacturing technique is completely avoided.

BRIEF DESCRIPTION OF THE DRAWINGS

Further features and advantages of the present invention will be evident from the detailed description of a preferred embodiment given by way of non-limiting example with reference to the accompanying drawings, wherein.

DETAILED DESCRIPTION OF THE PREFERRED EMBODIMENT

The present invention refers to a rotary vacuum pump, of the type comprising a rotating rotor disc cooperating with a stationary stator ring for obtaining a pumping effect.

More particularly, the present invention refers to a turbomolecular vacuum pump.

Figure 4:
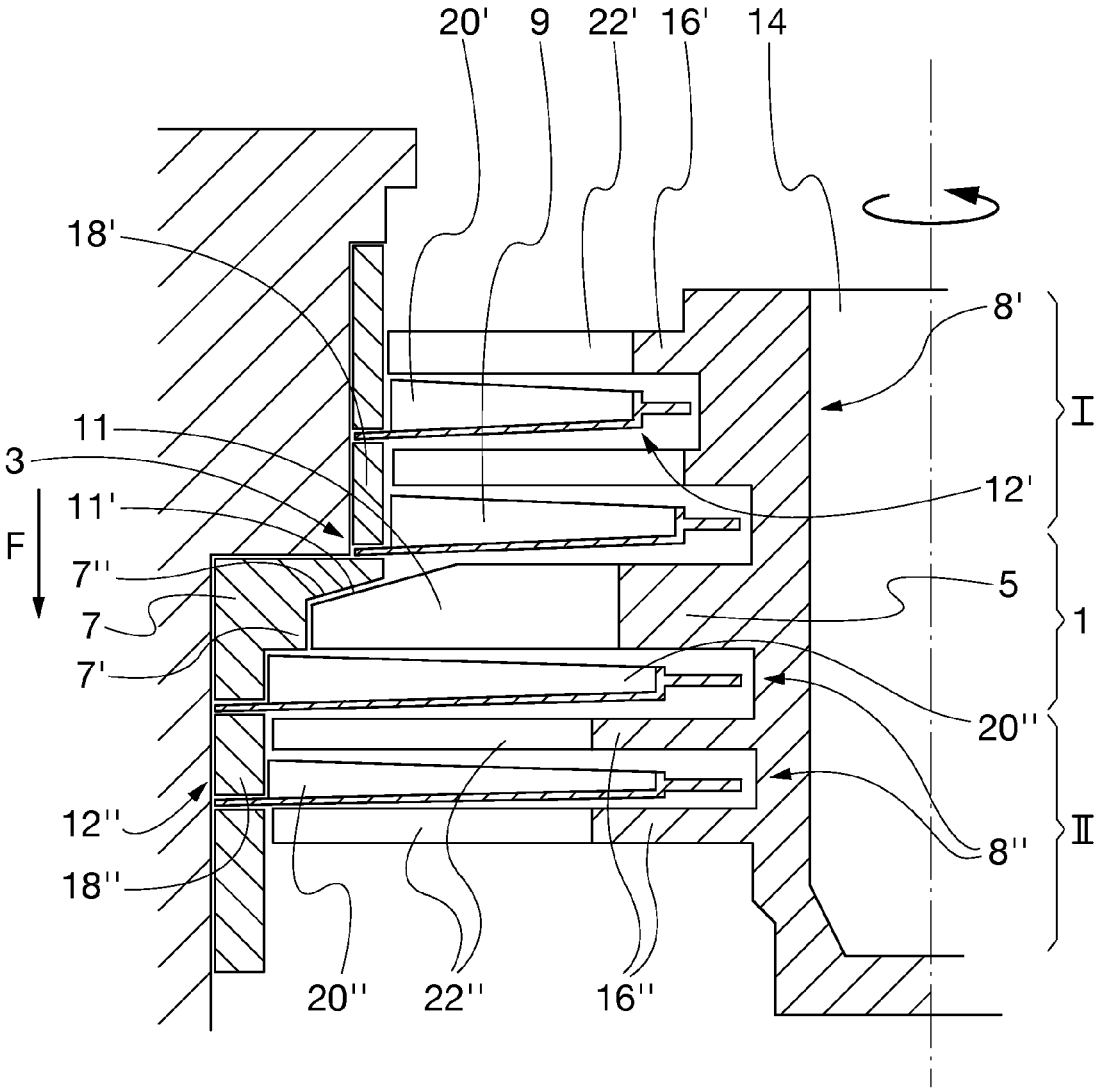
FIG. 4 is a schematic cross-sectional view partially showing a turbomolecular pump according to the invention.
Figure 5:
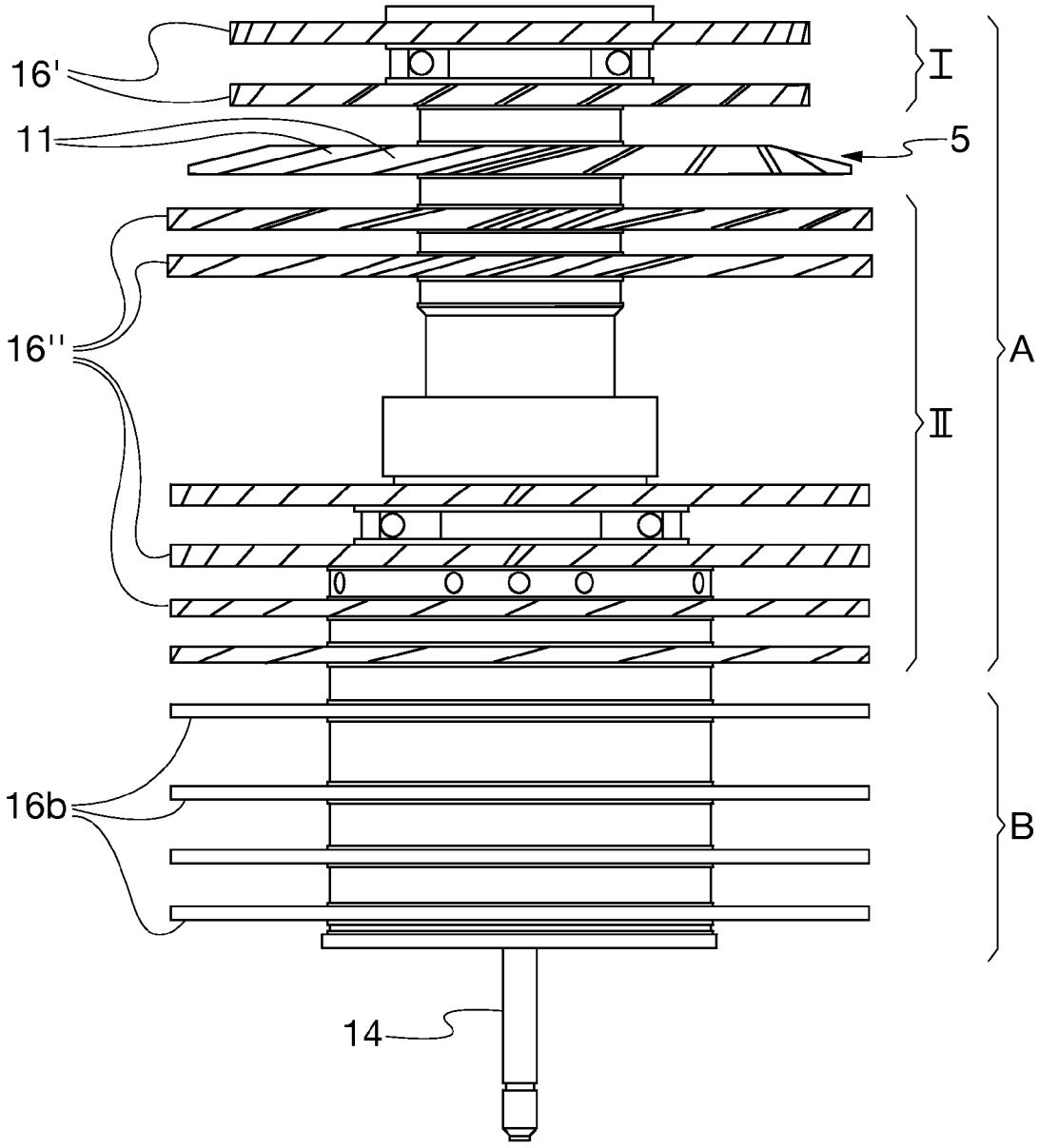
FIG. 5 is an elevation view of the rotor of the turbomolecular pump of FIG. 4.
Figure 6:
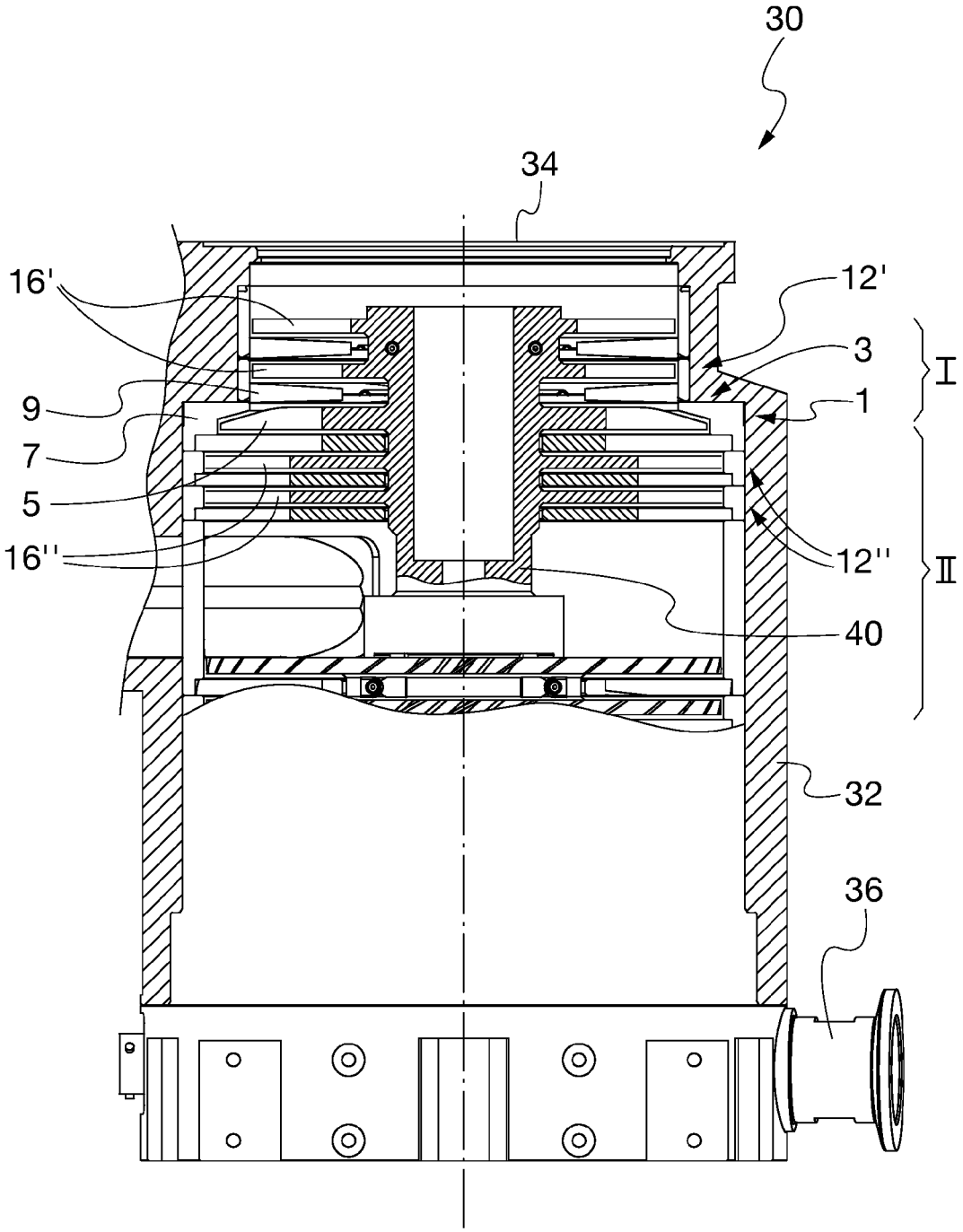
FIG. 6 is an elevation view, partially in cross-section, of the turbomolecular pump of FIG. 4.

FIGS. 4-6 refer to a preferred non-limiting embodiment of the invention wherein the rotary vacuum pump according to the invention is a turbomolecular pump.

Figure 1:
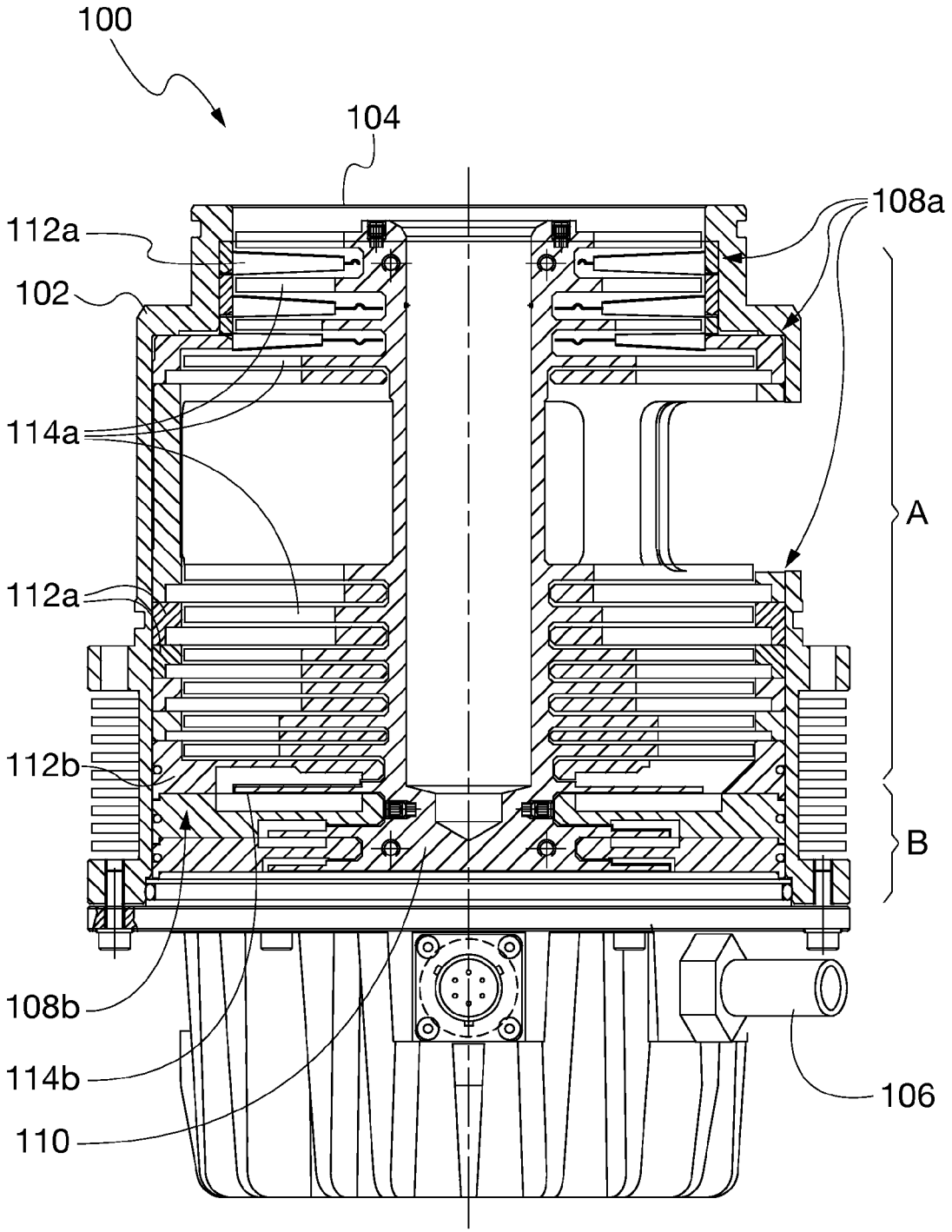
Fig. 1 (PRIOR ART)
FIG. 1 is a cross-sectional view of a turbomolecular pump according to prior art.
Figure 2:
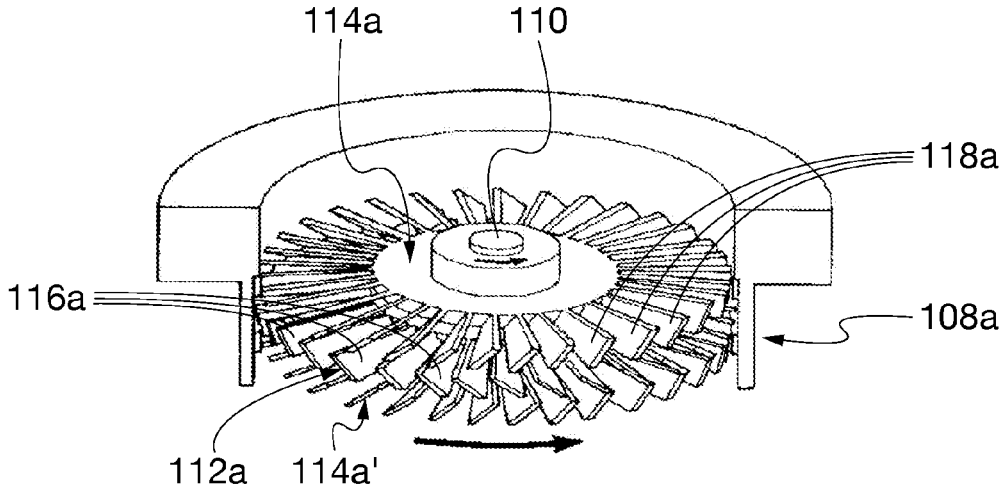
Fig. 2 (PRIOR ART)
FIG. 2 is a perspective view of a turbomolecular pumping stage of the pump of FIG. 1.
Figure 3:
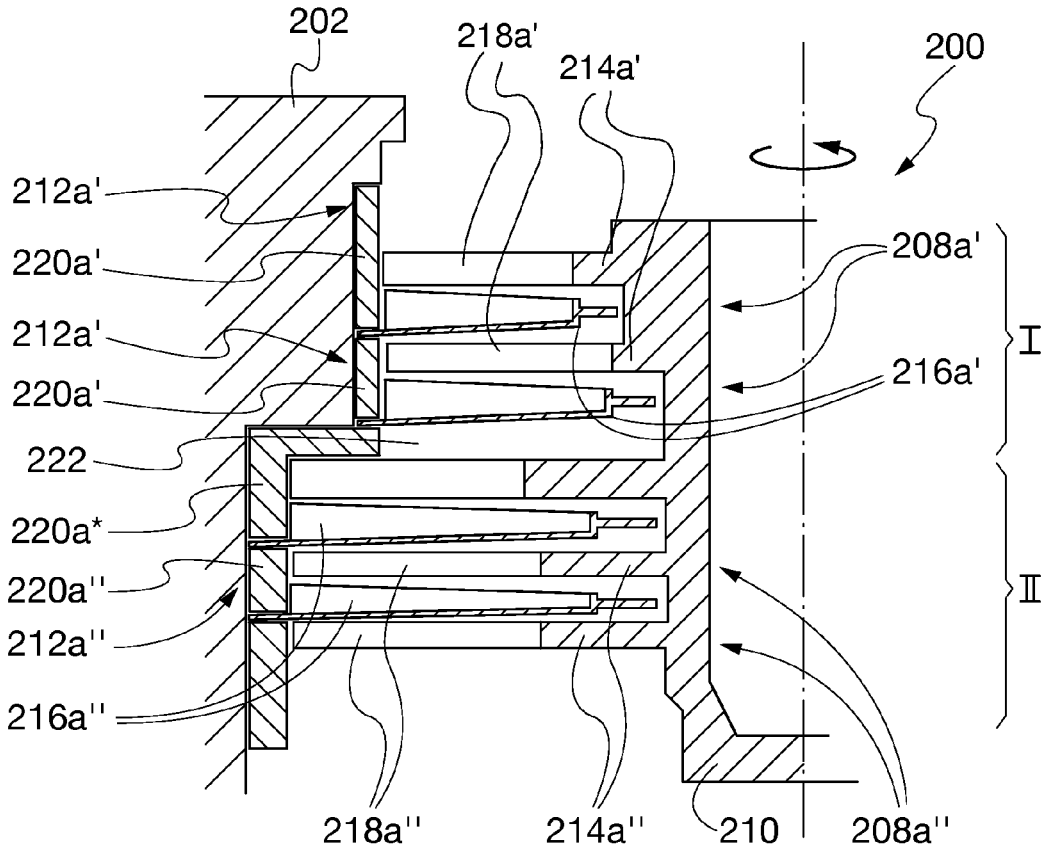
Fig. 3 (PRIOR ART)
FIG. 3 is a schematic cross-sectional view of a portion of another turbomolecular pump according to prior art.

Similarly to what shown in FIG. 3, the region at lower pressure of a turbomolecular pump, suitable for being arranged closer to the pump inlet port and comprising a plurality of turbomolecular pumping stages, is shown in FIG. 4.

Each turbomolecular pumping stage 8', 8" comprises a stator stage 12', 12" which is integral with the pump housing of the turbomolecular pump and cooperates with a rotor disc 16', 16" driven in rotation by a rotating shaft 14 centrally mounted in the pump housing.

Each rotor disc 16', 16" is equipped with radial blades 22', 22" equally spaced in the circumferential direction and each stator stage 12', 12" correspondingly consists of a spacer ring 18', 18" and of a stator ring 20', 20" equipped with radial blades equally spaced in the circumferential direction.

The turbomolecular pump shown in FIG. 4 comprises a first set I of turbomolecular pumping stages 8' with rotor discs 16' having a first diameter D1 followed—in the direction of the flow of pumped gas indicated by arrow F—by a second set II of turbomolecular pumping stages 8" with rotor discs 16" having a second different diameter D2.

In detail, in the illustrated example the first diameter D1 of the first set I of turbomolecular pumping stages is smaller than the second diameter D2 of the second set II of turbomolecular pumping stages.

According to the invention, an intermediate turbomolecular pumping stage 1 is provided between the first set I of turbomolecular pumping stages 8' and the second set II of turbomolecular pumping stages 8".

The intermediate pumping stage comprises a stator stage 3 integral with the pump housing and comprising a spacer ring 7 and a bladed stator ring 9 and a cooperating rotor disc 5 integral with the pump rotating shaft.

The rotor disc 5 has a diameter D that is comprised between the first diameter D1 of the first set I of rotor discs and the second diameter D2 of the second set II of rotor discs.

The rotor disc 5 is provided with a plurality of radial blades 11 equally spaced in the circumferential direction. The stator stage 3 correspondingly consists of a spacer ring 7 integral with the wall of the pump housing and of a bladed stator ring 9 carried by the spacer ring and with inclined blades equally spaced in the circumferential direction.

According to the invention, an outer portion in the radial direction of the rotor disc of the intermediate pumping stage 1 is axially tapered from its inner diameter toward its outer diameter and the spacer ring of the stator stage of the intermediate pumping stage is correspondingly axially tapered from its periphery toward its center.

With reference to the preferred embodiment of FIG. 4, an outer portion 11' in the radial direction of the blades 11 of the rotor disc 5 of the turbomolecular pumping stage 1 is axially tapered from their inner diameter to their outer diameter and the spacer ring 7 of the stator stage 3 is correspondingly axially tapered from its periphery toward its center. Thanks to this arrangement the axial clearance between the rotor disc 5 and the stator stage 3 is kept narrow, both in the axial and in the radial direction.

The axial clearance between the pumping stage 1 according to the invention and the adjacent pumping stages is also kept narrow.

At the same time, the spacer ring 7 on the whole has thickness large enough to guarantee the mechanical stability thereof.

Moreover, the spacer ring and the stator ring are made as separate pieces and no complex geometry is required, so that a bladed stator ring 9 obtained by stamping can be advantageously used, thus keeping the manufacturing costs low.

The tapering of the rotor disc and/or of the spacer ring of the stator stage can be smooth and continuous; for instance, in the illustrated example the tapering of the outer portion 11' of the rotor blades 11 is smooth and continuous.

As an alternative, the tapering of the rotor disc and/or of the spacer ring of the stator stage can be obtained through a stepped configuration.

As a further alternative, the tapering of the rotor disc and/or of the spacer ring of the stator stage can also be obtained through a combination of the above solutions; for instance, in the illustrated example the spacer ring 7 of the stator stage 3 comprises a first portion 7' with a stepped configuration and a second portion 7" smoothly and continuously tapered. In the illustrated example, in which the first diameter D1 of the first set I of turbomolecular pumping stages is smaller than the second diameter D2 of the second set II of turbomolecular pumping stages, the top surface of the rotor disc 5—more particularly of its blades 11—is axially tapered and correspondingly the spacer ring 7 of the stator stage 3 is upwardly tapered in the axial direction.

It is evident that, should the diameter of the first set I of turbomolecular pumping stages be lamer than the diameter of the second set II of turbomolecular pumping stages, the bottom surface of the rotor disc—or of its blades—would be axially tapered and correspondingly the spacer ring of the stator stage would be downwardly tapered in the axial direction.

Turning now to FIG. 5, the rotor of the exemplary turbomolecular pump according to the invention is shown.

The pump rotor comprises a plurality of rotor discs 16', 16", 16*b* carried by a rotating shaft 14. More particularly, the pump rotor includes a first region A, intended to be arranged closer to the inlet port of a pump housing and comprising a plurality of bladed rotor disc 16', 16" and a second region B, arranged downstream to the first region A in the direction of the flow of a pumped gas and comprising a plurality of smooth rotor discs 16*b*.

With specific reference to the first region A of the pump rotor, a first set I of rotor discs 16' having a smaller diameter and a second set II of rotor discs 16" having a larger diameter are provided; according to the invention an intermediate rotor disc 5 having an intermediate diameter and comprising blades 11 having an outer portion in the radial direction that is axially tapered from their inner diameter toward their outer diameter is interposed between the first set I of rotor discs 16' having a smaller diameter and the second set II of rotor discs 16" having a larger diameter.

With reference now to FIG. 6, a turbomolecular pump 30 according to the invention is shown.

The turbomolecular pump 30 comprises a housing 32 provided with a pump inlet 34 and a pump outlet 36. The pump rotor shown in FIG. 5 is mounted into the housing 32 so that the turbomolecular rotor discs 16', 16" of the rotor, cooperating with corresponding stator stages 12', 12" integral with the housing 32, form a plurality of turbomolecular pumping stages; correspondingly the molecular rotor discs (not shown) of the rotor, cooperating with corresponding stator stages (not shown) integral with the housing 32, form a plurality of drag molecular pumping stages, arranged downstream the turbomolecular pumping stages.

As clearly shown in FIG. 6, the turbomolecular pump 30 comprises a first set I of pumping stages having rotor discs 16' with a first diameter and a second set II of pumping stages having rotor discs 16" with a second different diameter and it further comprises an intermediate pumping stage 1, which comprises a rotor disc 5 having a diameter comprised between the first diameter and the second diameter and comprising an outer portion in the radial direction that is axially tapered from its inner diameter toward its outer diameter and a stator stage 3 comprising a stator ring 9 cooperating with the rotor disc 5 and a spacer ring 7 that is axially tapered from its periphery toward its center. Thanks to the interposition of such intermediate turbomolecular pumping stage 1 between the first set I of turbomolecular pumping stages with rotor discs 16' having a smaller diameter and the second set II of turbomolecular pumping stages with rotor discs 16" having a larger diameter, the axial clearance between rotor discs and cooperating stator rings can be kept narrow along the whole path of the pumped gas throughout the pump.

It is therefore evident that the rotary vacuum pump according to the invention achieves the objects set forth above.

It is also evident that the above description has been given only by way of non-limiting example and that several modifications are possible without departing from the scope of the invention as defined in the appended claims.

More particularly, although the illustrated preferred embodiment refers to a turbomolecular pump, it is evident that the invention could also be applied to a molecular pump comprising molecular drag pumping stages comprising smooth rotor discs cooperating with smooth stator rings.

Moreover, although the illustrated preferred embodiment refers to a stator stage comprising a spacer ring and a separate stator ring, it is evident that the spacer ring and the stator ring could be integrated in a single piece—i.e. the stator stage could be made as a single piece—without departing from the scope of the invention as defined in the appended claims.

The invention claimed is:

1. A rotary vacuum pump comprising:

a pump housing in which an inlet port and an outlet port are defined;

a plurality of pumping stages arranged inside the pump housing between the inlet port and the outlet port for pumping a gas from the inlet port to the outlet port, each of the pumping stages comprising a stator stage integral with the pump housing and a cooperating rotor disc integral with a rotating shaft centrally arranged in the housing, wherein the plurality of pumping stages comprises:

a first set of pumping stages having rotor discs with a first outer diameter followed in the flow direction of the pumped gas by a second set of pumping stages having rotor discs with a second outer diameter different from the first outer diameter; and an intermediate pumping stage interposed between the first set of pumping stages and the second set of pumping stages, the intermediate pumping stage comprising:

a rotor disc of the intermediate pumping stage having an inner diameter, and an outer diameter between the first outer diameter and the second outer diameter, and comprising an outer portion in a radial direction from the shaft that is axially tapered from the inner diameter toward the outer diameter; and a stator stage of the intermediate pumping stage comprising a stator ring cooperating with the rotor disc of the intermediate pumping stage, and a spacer ring comprising a periphery and a center, wherein the spacer ring is axially tapered from the periphery toward the center.

2. The rotary vacuum pump according to claim 1, wherein the first outer diameter is smaller than the second outer diameter.

3. The rotary vacuum pump according to claim 2, wherein the rotor disc of the intermediate pumping stage comprises a top surface that is axially tapered, and the spacer ring of the stator stage of the intermediate pumping stage is upwardly tapered in the axial direction.

4. The rotary vacuum pump according to claim 1, wherein the first outer diameter is larger than the second outer diameter.

5. The rotary vacuum pump according to claim 4, wherein the rotor disc of the intermediate pumping stage comprises a bottom surface that is axially tapered, and the spacer ring of the stator stage of the intermediate pumping stage is downwardly tapered in the axial direction.

6. The rotary vacuum pump according to claim 1, wherein the tapering of the rotor disc of the intermediate pumping stage is smooth and continuous.

7. The rotary vacuum pump according to claim 1, wherein the tapering of the spacer ring of the stator stage of the intermediate pumping stage is smooth and continuous.

8. The rotary vacuum pump according to claim 1, wherein the tapering of the rotor disc of the intermediate pumping stage is obtained through a stepped configuration.

9. The rotary vacuum pump according to claim 1, wherein the tapering of the spacer ring of the stator stage of the intermediate pumping stage is obtained through a stepped configuration.

10. The rotary vacuum pump according to claim 1, wherein the tapering of the rotor disc of the intermediate pumping stage is obtained through the combination of a smooth and continuous portion and of a stepped portion.

11. The rotary vacuum pump according to claim 1, wherein the tapering of the spacer ring of the stator stage of the intermediate pumping stage is obtained through the combination of a smooth and continuous portion and of a stepped portion.

12. The rotary vacuum pump according to claim 1, wherein the rotary vacuum pump is a turbomolecular pump comprising a first region comprising a plurality of turbomolecular pumping stages and a second region comprising a plurality of molecular drag pumping stages wherein the pumping stages of the first set of pumping stages, the pumping stages of the second set of pumping stages as well as the intermediate pumping stage are turbomolecular pumping stages.

13. The rotary vacuum pump according to claim 1, wherein the rotary vacuum pump is a turbomolecular pump comprising a first region comprising a plurality of turbomolecular pumping stages and a second region comprising a plurality of molecular drag pumping stages wherein the pumping stages of the first set of pumping stages, the pumping stages of the second set of pumping stages as well as the intermediate pumping stage are molecular drag pumping stages.

14. The rotary vacuum pump according to claim 13, wherein the rotor disc of the intermediate pumping stage is provided with a plurality of radial blades equally spaced in the circumferential direction and wherein an outer portion in the radial direction of the blades is axially tapered from their inner diameter to their outer diameter.

15. The rotary vacuum pump according to claim 14 wherein the stator ring of the stator stage of the intermediate pumping stage is equipped with a plurality of radial blades equally spaced in the circumferential direction.

16. The rotary vacuum pump according to claim 13, wherein the stator ring is obtained by stamping.

17. The rotary vacuum pump according to claim 1, wherein the spacer ring and the stator ring of the stator stage of the intermediate pumping stage are made as separate pieces.

18. The rotary vacuum pump according to claim 1, wherein the spacer ring and the stator ring of the stator stage of the intermediate pumping stage are made as a single piece.

* * * * *